US005301820A

United States Patent [19]

Rossmoore

[11] Patent Number: 5,301,820

[45] Date of Patent: * Apr. 12, 1994

[54] DISPLAY CASE

[76] Inventor: Howard Rossmoore, 1879 Fiesta Dr., Sarasota, Fla. 34231

[ * ] Notice: The portion of the term of this patent subsequent to May 18, 2010 has been disclaimed.

[21] Appl. No.: 62,177

[22] Filed: May 17, 1993

Related U.S. Application Data

[63] Continuation-in-part of Ser. No. 807,104, Dec. 13, 1991, Pat. No. 5,211,293.

[51] Int. Cl.[5] ..... A47F 5/00

[52] U.S. Cl. ..... 211/42; 211/134

[58] Field of Search ..... 211/59.2, 42, 43, 135, 211/90, 186

[56] References Cited

U.S. PATENT DOCUMENTS

| | | | |
|---|---|---|---|
| D. 165,940 | 2/1952 | Smilie | 211/42 X |
| 2,639,040 | 5/1953 | Tapley | 211/135 X |
| 3,223,246 | 12/1965 | Daitch . | |
| 3,549,019 | 12/1970 | Wood et al. . | |
| 4,095,858 | 6/1978 | Hopf . | |
| 4,930,640 | 6/1990 | Edwards . | |
| 5,211,293 | 5/1993 | Rossmoore | 211/42 |

FOREIGN PATENT DOCUMENTS

| | | | |
|---|---|---|---|
| 193105 | 12/1964 | Sweden | 211/42 |

*Primary Examiner*—Robert W. Gibson, Jr.
*Attorney, Agent, or Firm*—Spensley Horn Jubas & Lubitz

[57] ABSTRACT

A display case including, in various combinations, a frame, a horizontal shelf, an inclined shelf, a shelf extension extending from the shelf and a support member extending perpendicularly from a shelf.

29 Claims, 4 Drawing Sheets

DISPLAY CASE

This application is a continuation-in-part of U.S. application Ser. No. 07/807,104, filed Dec. 13, 1991, now U.S. Pat. No. 5,211,293.

BACKGROUND OF THE INVENTION

1. Field of the Invention

The present invention is directed to a display case which may be used to display books, compact discs, art work, photographs or other items.

2. Description of the Related Art

Prior art display cases commonly include only horizontal shelves. There are, however, a number of disadvantages associated with the use of horizontal shelves. For example, when a horizontal shelf is partially filled with books, the books often tip over. Such books may also be damaged due to the effects of their own weight. Accordingly, support devices such as a bookends, which firmly press the books against one another, must be used in conjunction with a partially filled horizontal shelf.

Another problem associated with horizontal shelves is that books are often produced with the title printed on the spine of the book in such a manner that when the book is stored on a shelf,.the title is oriented 90 degrees from a normal horizontal reading orientation. Such an orientation causes problems for persons attempting to read the titles such as eye and neck strain. Moreover, a person who is looking for a particular book in a bookstore may fail to find the desired book altogether. Accordingly, bookstores may lose sales as a result of the reading difficulties associated with the orientation of the titles of books arranged on horizontal shelves.

Other problems associated with prior art display cases are related to the fact that each of the respective shelves has a uniform depth along its entire length. For example, a shelf may be one foot deep along its entire length. The uniform depth makes it difficult to store items whose respective sizes vary. For example, in a bookstore the vast majority of books may fit on a shelf having a depth of one foot. Shelves may be designed accordingly. However, on occasion, books which are substantially larger than the majority may have to be displayed. These larger books are often simply placed on a shelf which is too small to completely support them. As such, a portion of each of these books hangs over the edge of the shelf. This causes damage to the books.

Uniform shelf depth also makes it difficult to prominently display a particular item, such as a piece of art work, a trophy, or a special book. One way to prominently display such an item on a shelf of uniform depth is to leave the shelf space around the item empty. Such a display method, however, wastes valuable shelf space. Moreover, the item which is to be prominently displayed may still not "jump out" at viewers.

SUMMARY OF THE INVENTION

It is an object of the present invention to provide a display case which obviates, for practical purposes, the aforementioned problems associated with the prior art.

In accordance with one aspect of the present invention, the display case may include at least one inclined shelf. The use of the inclined shelf provides a number of advantages over the prior art. For example, an inclined shelf which is partially filled with books does not require the use of a support device to keep the books firmly pressed against one another. The force of gravity pushes the books downwardly against one another. Thus, the problems of books tipping over and book damage associated with horizontal shelves are eliminated. Additionally, the titles of books arranged on an inclined shelf are oriented closer to a normal horizontal orientation than they would be on a horizontal shelf. Thus, the titles are easier to read and problems such as eye and neck strain may be reduced or eliminated.

In accordance with another aspect of the present invention, the top portion of a display case frame may include an inclined portion. The top portion of the frame, therefore, may be advantageously used to store books in a manner similar to the inclined shelves.

In accordance with a further aspect of the present invention, the display case may include a shelf extension which may extend either forwardly or rearwardly from a shelf. The shelf extension may or may not be coplanar with the shelf. The shelf extension may be used to support portions of books which are too big to completely fit on the shelf. The shelf extension may also be used for display purposes. If the shelf extension extends forwardly from the shelf, then an item displayed thereon will be closer to a person viewing the display case than other items arranged on the shelf. Accordingly, the item displayed on the shelf extension will be more prominently displayed than the other items. Thus, the shelf extension may be especially useful in a commercial setting for displaying specially priced or new merchandise. Used in the home, the shelf extension may be useful for displaying art work, trophies, or photographs of which the owner is particularly proud.

In accordance with a still further aspect of the present invention, the shelf extension may be removeably secured to the corresponding shelf. Thus, the shelf extension may be easily moved from one portion of the display case to another.

BRIEF DESCRIPTION OF THE DRAWINGS

A detailed description of the preferred embodiment of the invention will be made with reference to the accompanying drawings.

DESCRIPTION OF THE PREFERRED EMBODIMENT:

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
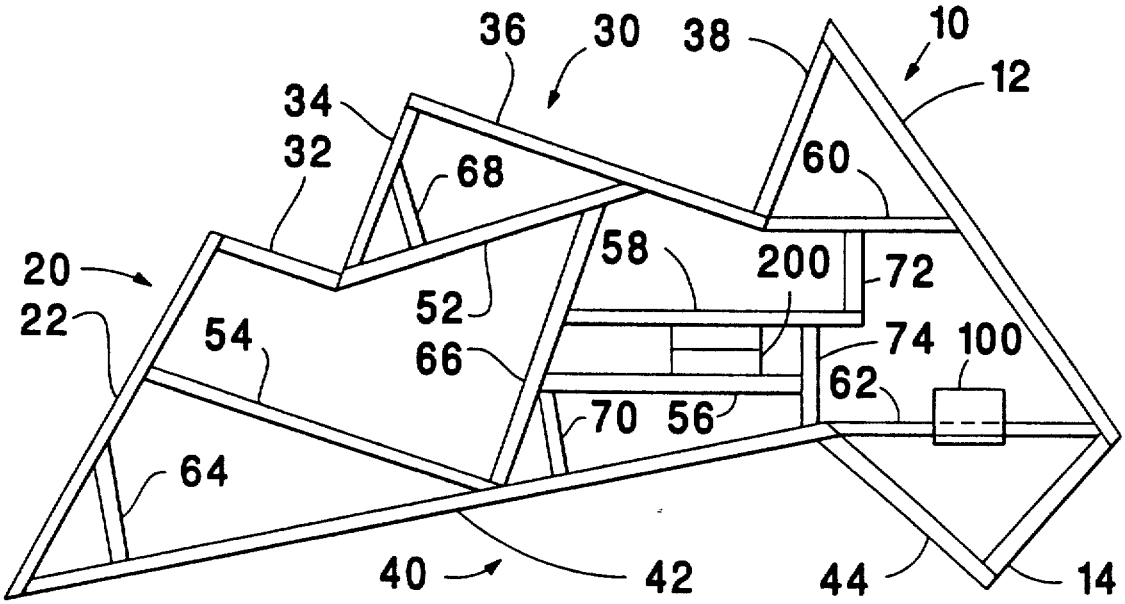
FIG. 1 is a front elevation view a display case in accordance with the present invention.

As illustrated for example in FIG. 1, a preferred embodiment of a display case in accordance with the present invention may include an outer frame having a first side portion 10, itself including side members 12 and 14, and second side portion 20, itself including a side member 22. The outer frame may also include a top portion 30, itself including top members 32, 34, 36 and 38, and a bottom portion 40, itself including bottom members 42 and 44. A number of shelves may be arranged within the frame. The shelves include inclined shelves 52 and 54 which are inclined between the first side portion 10 and second side portion 20 and are horizontal from front to back. The shelves may also include horizontal shelves 56, 58, 60 and 62. Support members 64, 66, 68, 70, 72 and 74 may respectively extend perpendicularly from the bottom member 42, the inclined shelf 54, the inclined shelf 52, the bottom member 42, the horizontal shelf 58 and the horizontal shelf 56.

The preferred embodiment may also include a number of shelf extensions which may extend either forwardly or rearwardly from the display case. For example, shelf extensions 100 and 200 may be respectively attached to the horizontal shelf 62 and horizontal shelves 56 and 58. Such shelf extensions may also be attached to one or more of the inclined shelves.

In accordance with the preferred embodiment, the frame, shelves, support members and extension members may be formed from wood, metal, glass, plastic and other appropriate materials known to those of skill in the art, as well as combinations thereof. The frame, shelves, support members and extension members may be secured to one another through the use of nails, screws, glue, clamps, fasteners, welds and other appropriate means known to those of skill in the art, as well as combinations thereof.

Figure 2:
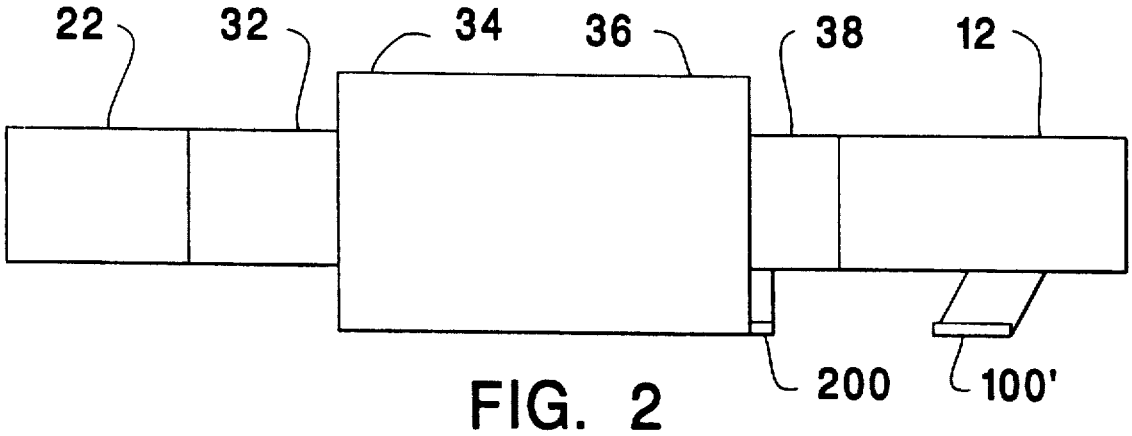
FIG. 2 is a top view of a display case in accordance with the present invention.

As shown by way of example in FIG. 2, the top members 34 and 36 (as well as inclined shelf 52 and support member 68) may have a greater depth than other portions of the display case. Additionally, one or more of the bottom members or one or more of the horizontal shelves may have a greater depth than other portions of the display case.

Figure 3:
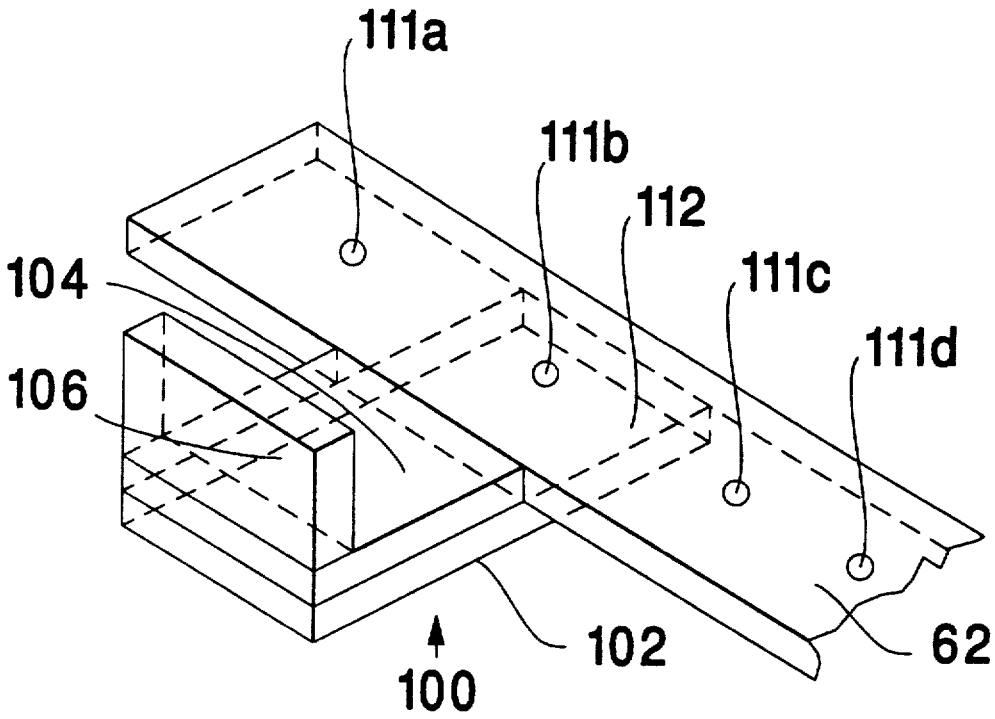
FIG. 3 is a perspective view of one example of a shelf extension accordance with the present invention.

One embodiment of a shelf extension in accordance with the present invention is illustrated for example in FIG. 3. The shelf extension 100 (FIG. 1) may include base portion 102 which may be removeably secured to the shelf 62 by, for example, a nut and bolt arrangement 112. The shelf 62 may be provided with a number of holes 111*a*-111*d* to facilitate attachment along the length of the shelf. The shelf extension 100 may also include a top portion 104 and a support member 106.

Figure 4:
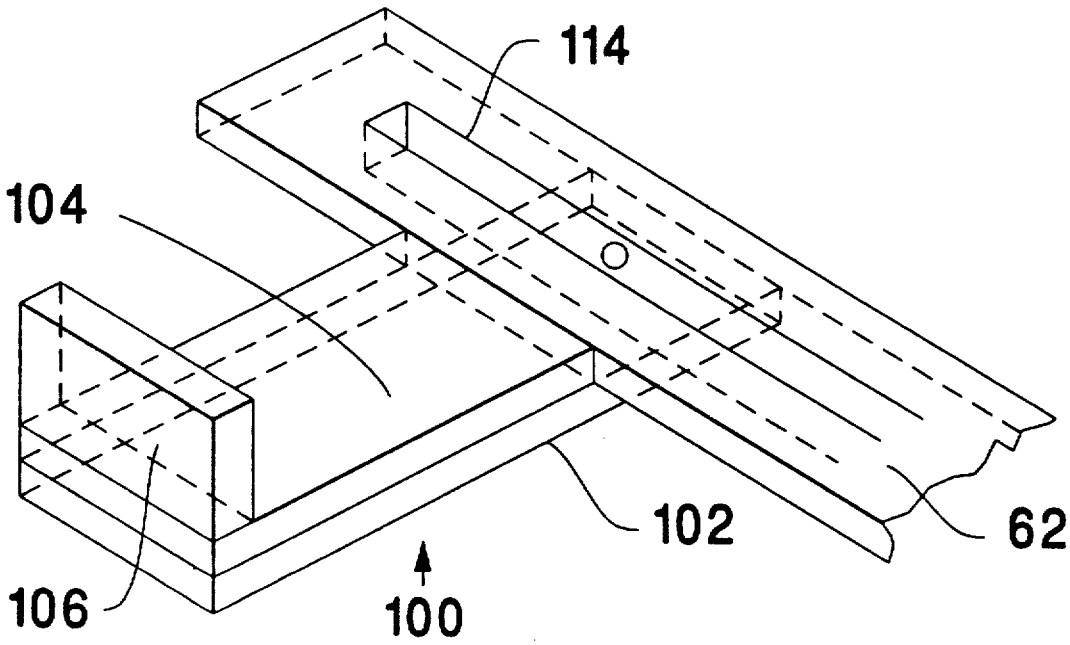
FIG. 4 is a perspective view of another example of a shelf extension in accordance with the present invention.

Alternatively, as illustrated for example in FIG. 4, the shelf 62 may be provided with a slot 114. When the nut and bolt arrangement is loosened, the shelf extension 100 may be slid along the length of the shelf 62 until the desired position is reached. At the desired position, the nut and bolt arrangement 112 may be tightened to secure the shelf extension 100 in place.

Figure 5:
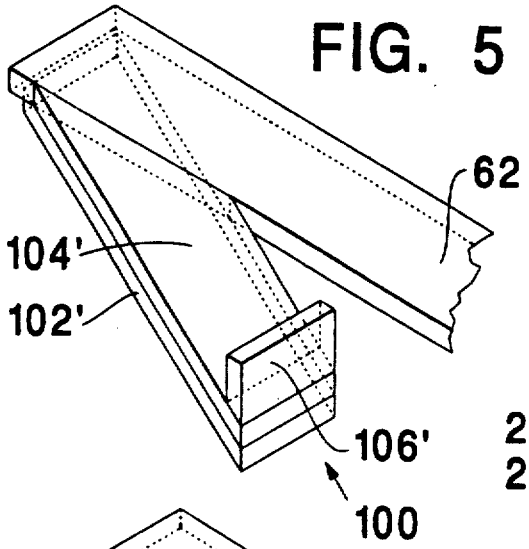
FIG. 5 is a perspective view of a further example of a shelf extension in accordance with the present invention.

The shelf extension 100 may extend perpendicularly from the shelf 62 in the manner illustrated in FIGS. 3 and 4. Alternatively, as illustrated for example in FIG. 5, a shelf extension 100' may be arranged at an acute angle $\alpha$ with respect to the shelf 62. The shelf extension 100' may include a base portion 102', a top portion 104' and a support member 106'. The base portion 102' may be removeably secured to the shelf 62 in one of the manners described above with reference to FIGS. 3 and 4.

Figure 6:
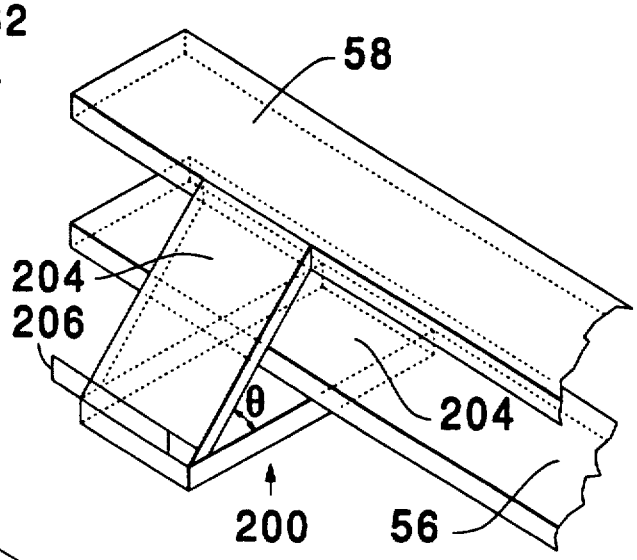
FIG. 6 is a perspective view of a still further example of a shelf extension in accordance with the present invention.

Another embodiment of a shelf extension in accordance with the present invention is illustrated for example in FIG. 6. The shelf extension 200 (FIG. 1) may include base portion 202 which may be removeably secured to the shelf 56 in one of the manners described above with reference to FIGS. 3 and 4. The shelf extension 200 may also include a top portion 204 which may abut the shelf 58. Also, the shelf extension 200 may include a support member 206. The base portion 202 and the top portion 204 define an angle $\theta$. The angle $\theta$ varies in accordance with the size of the base portion 202 and the top portion 204 and the distance between the shelves 56 and 58.

Figure 7:
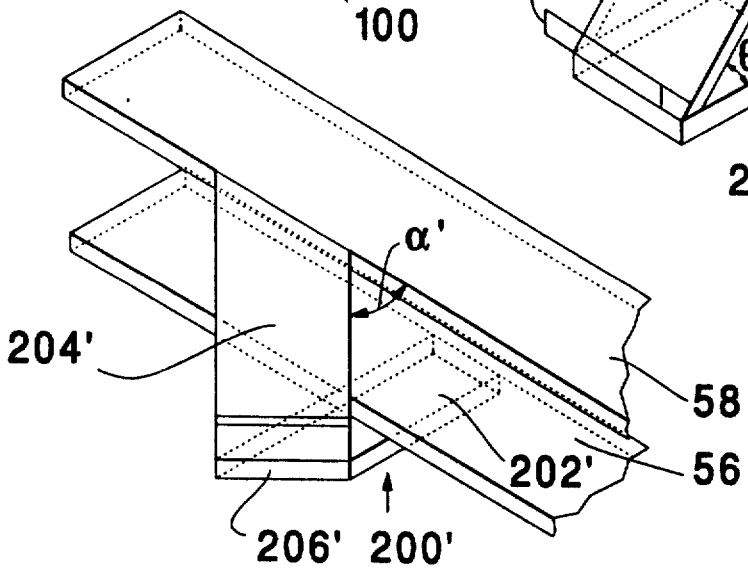
FIG. 7 is a perspective view of a still further example of a shelf extension in accordance with the present invention.

The shelf extension 200 may extend perpendicularly from the shelf 58 in the manner illustrated in FIG. 6. Alternatively, as illustrated for example in FIG. 7, a shelf extension 200' may be arranged at an acute angle $\alpha'$ with respect to the shelf 58. The shelf extension 200' may include a base portion 202', and a top portion 204' which may abut the shelf 58. The shelf extension 200' may also include a support member 206'. The base portion 202' may be removeably secured to the shelf 56 in one of the manners described above with reference to FIGS. 3 and 4.

Figure 8:
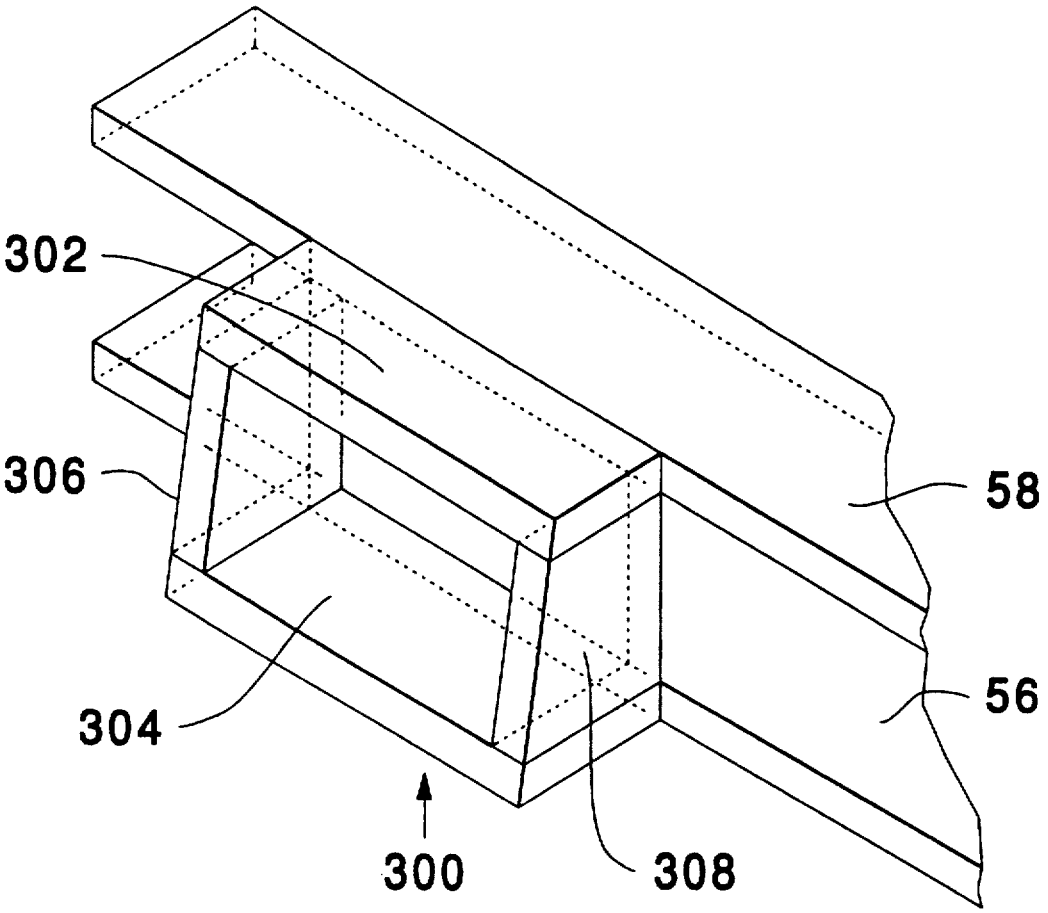
FIG. 8 is a perspective view of a still further example of a shelf extension in accordance with the present invention.

A further embodiment of a shelf extension in accordance with the present invention is illustrated for example in FIG. 8. A shelf extension 300 may include top and bottom portions 302 and 304 which may be respectively attached to shelves 58 and 56 in a cantilevered fashion by, for example, wood screws. Alternatively, a base portion may be arranged beneath the bottom portion 304. The base portion may be removeably secured to the shelf 56 in one of the manners described above with reference to FIGS. 3 and 4. The shelf extension 300 may also include side portions 306 and 308. The top, bottom and side portions combine to provide a generally "box-like" shelf extension.

Figure 9:
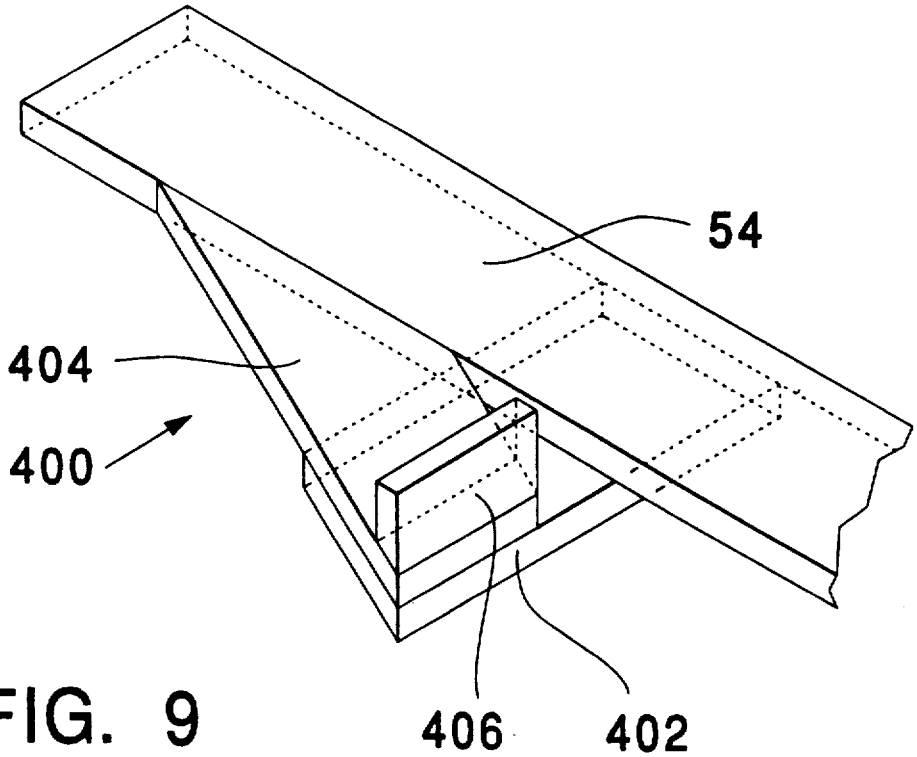
FIG. 9 is a perspective view of a still further example of a shelf extension in accordance with the present invention.

With appropriate modification, any of the preceding shelf extension embodiments may be used with inclined shelves. One example of a shelf extension which may be attached to an inclined shelf is illustrated in FIG. 9. A shelf extension 400 may include a base portion 402 which may be removeably secured to the shelf 54 (FIG. 1) in one of the manners described above with reference to FIGS. 3 and 4. The shelf extension 400 may also include a top portion 404 and an inclined support member 406.

Although the present invention has been described in terms of a preferred embodiment above, numerous modifications and/or additions to the above-described preferred embodiment would be readily apparent to one skilled in the art. It is intended that the scope of the present invention extends to all such modifications and/or additions and that the scope of the present invention is limited solely by the claims set forth below.

I claim:

1. A display case, comprising:

a frame including first and second side portions, a top portion, and a bottom portion;

at least one substantially horizontal shelf adapted to support objects;

at least one inclined shelf adapted to support objects; and at least one shelf extension extending from one of the at least one substantially horizontal shelf and the at least one inclined shelf.

2. The display case of claim 1, wherein the at least one shelf extension defines an extension plane and the one of the at least one substantially horizontal shelf and the at least one inclined shelf defines a shelf plane, the extension plane and shelf plane being substantially coplanar.

3. The display case of claim 2, further comprising a support member extending substantially perpendicularly from the at least one shelf extension.

4. The display case of claim 2, wherein the one of the at least one substantially horizontal shelf and the at least one inclined shelf defines a first longitudinal axis and the at least one shelf extension defines a second longitudinal axis, the first and second longitudinal axis defining an acute angle.

5. The display case of claim 1, wherein the at least one shelf extension defines an extension plane and the one of the at least one substantially horizontal shelf and the at least one inclined shelf defines a shelf plane, the extension plane and the shelf plane defining an obtuse angle.

6. The display case of claim 5, further comprising a support member extending substantially perpendicularly from the at least one shelf extension.

7. The display case of claim 5, wherein the one of the at least one substantially horizontal shelf and the at least one inclined shelf defines a first longitudinal axis and the at least one shelf extension defines a second longitudinal axis, the first and second longitudinal axis defining an acute angle.

8. The display case of claim 1, wherein the at least one substantially horizontal shelf comprises a first substantially horizontal shelf defining a first depth and a second substantially horizontal shelf defining a second depth, the first depth being substantially greater than the second depth.

9. The display case of claim 1, wherein the at least one inclined shelf comprises a first inclined shelf defining a first depth and a second inclined shelf defining a second depth, the first depth being substantially greater than the second depth.

10. The display case of claim 1, wherein the at least one substantially horizontal shelf defines a first depth and the at least one inclined shelf defines a second depth, the first and second depths being substantially unequal.

11. The display case of claim 1, further comprising a support member extending substantially perpendicularly from the at least one substantially horizontal shelf.

12. The display case of claim 1, further comprising a support member extending substantially perpendicularly from the at least one inclined shelf.

13. The display case of claim 1, wherein at least one of the first and second side portions comprises at least one substantially non-vertical member.

14. The display case of claim 1, wherein at least one of the top and bottom portions comprises at least one inclined member.

15. The display case of claim 1, further comprising:

attachment means for removeably securing the at least one shelf extension to the one of the at least one substantially horizontal shelf and the at least one inclined shelf.

16. The display case of claim 1, wherein the at least one inclined shelf comprises first and second inclined shelves arranged at first and second angles of inclination, respectively, the first angle being substantially different than the second angle.

17. A display case, comprising:

a frame including first and second side portions, a top portion, a bottom portion;

at least one substantially horizontal shelf adapted to support objects, the at least one substantially horizontal shelf defining first and second ends and a support portion between the first and second ends;

at least one inclined shelf adapted to support objects, the at least one inclined shelf defining first and second ends and a support portion between the first and second ends; and at least one support member extending substantially perpendicularly from one of the first end of the at least one substantially horizontal shelf, the support portion of the at least one substantially horizontal shelf, the first end of the at least one inclined shelf and the support portion of the at least one inclined shelf.

18. The display case of claim 17, wherein the at least one inclined shelf comprises first and second inclined shelves arranged at first and second angles, respectively, the first angle being substantially different than the second angle.

19. The display case of claim 17, wherein at least one of the first and second side portions comprises at least one substantially non-vertical member.

20. The display case of claim 17, wherein at least one of the top and bottom portions comprises at least one inclined member.

21. The display case of claim 17, wherein the at least one substantially horizontal shelf comprises a first substantially horizontal shelf defining a first depth and a second substantially horizontal shelf defining a second depth, the first depth being substantially greater than the second depth.

22. The display case of claim 17, wherein the at least one inclined shelf comprises a first inclined shelf defining a first depth and a second inclined shelf defining a second depth, the first depth being substantially greater than the second depth.

23. The display case of claim 17, wherein the at least one substantially horizontal shelf defines a first depth and the at least one inclined shelf defines a second depth, the first and second depths being substantially unequal.

24. A display case, comprising:

a frame including first and second side portions, at least one of the first and second side portion including a non-vertical member, a top portion and a bottom portion, at least one of the top and bottom portions including an inclined member;

at least one substantially horizontal shelf adapted to support objects:

a first support member extending perpendicularly from the at least one substantially horizontal shelf;

at least one inclined shelf adapted to support objects;

a second support member extending perpendicularly from the at least one inclined shelf;

a first shelf extension extending from the at least one substantially horizontal shelf; and a second shelf extension extending from the at least one inclined shelf.

25. A display case, comprising:

a frame including first and second side portions, a top portion and a bottom portion, the frame defining a compartment open in the front;

a shelf arranged substantially within the compartment, the shelf being inclined in a direction between the first and second side portions and substantially horizontal from front to back; and a shelf extension extending from the shelf.

26. A display case, comprising:

a frame including first and second side portions, a top portion and a bottom portion, the frame defining a compartment open in the front;

a shelf arranged substantially within the compartment, the shelf being inclined in a direction between the first and second side portions and substantially horizontal from front to back; and a support member extending substantially perpendicularly form the shelf.

27. A display case, comprising:

a frame including first and second side portions;

a first shelf arranged substantially between the first and second side portions, the first shelf being inclined in a direction between the first and second side portions and substantially horizontal from front to back; and a second shelf arranged substantially between the first and second side portions, the second shelf being substantially horizontal in a direction between the first and second side portions.

28. The display case of claim 27, further comprising:

a shelf extension extending from one of the first and second shelves.

29. The display case of claim 27, further comprising:

a support member extending substantially perpendicularly from one of the first and second shelves.

* * * * *